US008505138B1

(12) United States Patent
Minichiello et al.

(10) Patent No.: US 8,505,138 B1
(45) Date of Patent: Aug. 13, 2013

(54) ADJUSTABLE BACK PLATFORM DEVICE

(76) Inventors: Thomas Minichiello, LaQuinta, CA (US); Roberta Minichiello, LaQuinta, CA (US)

( * ) Notice: Subject to any disclaimer, the term of this patent is extended or adjusted under 35 U.S.C. 154(b) by 250 days.

(21) Appl. No.: 12/717,289

(22) Filed: Mar. 4, 2010

(51) Int. Cl.
*A47C 20/00* (2006.01)

(52) U.S. Cl.
USPC ..... 5/632; 5/11; 280/32.6

(58) Field of Classification Search
USPC ..... 5/11, 630, 632, 400, 200.1, 205, 5/652, 110, 633, 655, 3, 203, 288, 290, 310, 5/657; 280/32.5, 32.6; 108/144.11, 54.1, 108/901, 43, 51.11; 297/423.14–423.16, 297/423.39, 423.41; 248/346.01, 346.02, 248/678, 161, 157, 188, 188.4; 482/52
See application file for complete search history.

(56) References Cited

U.S. PATENT DOCUMENTS

| | | | | |
|---|---|---|---|---|
| 3,269,621 | A * | 8/1966 | Dishart | 224/585 |
| 3,677,569 | A | 7/1972 | Larson | |
| 4,272,136 | A * | 6/1981 | Sengua | 312/196 |
| 4,700,945 | A | 10/1987 | Rader | |
| D299,178 | S | 12/1988 | Smith | |
| 6,216,289 | B1 * | 4/2001 | Woods | 5/200.1 |
| D503,867 | S | 4/2005 | Bennette et al. | |
| 6,948,199 | B2 * | 9/2005 | Hooper, Jr. | 5/200.1 |
| 7,305,728 | B2 | 12/2007 | Schlieps | |
| 2001/0024022 | A1 | 9/2001 | Antirose | |
| 2006/0200909 | A1 | 9/2006 | Beck | |
| 2007/0176378 | A1 * | 8/2007 | Bangs | 280/32.6 |

* cited by examiner

*Primary Examiner* — Nicholas Polito

(57) ABSTRACT

An adjustable back platform device featuring a base panel having side wall extending from side edges, the walls being positioned generally parallel to one another; a hole disposed in both the first side panel and in the second side panel, the holes function as handles to allow the adjustable back platform device to be lifted; and a first adjustable leg, a second adjustable leg, and a third adjustable leg, each adjustable leg being disposed on a bottom surface of the base panel, the adjustable legs allow a distance between the base panel and a floor surface to be modified; wherein when a user lies atop the base panel, the back platform device functions to raise the user's back a certain distance off the floor surface so as to align the user's back with a bottom floor of a cabinet.

6 Claims, 4 Drawing Sheets

ADJUSTABLE BACK PLATFORM DEVICE

FIELD OF THE INVENTION

The present invention is directed to body supports and the like, more particularly to a support platform for supporting a user's back when working on plumbing in a cabinet.

BACKGROUND OF THE INVENTION

Performing tasks in a cabinet, such as a cabinet under a kitchen or bathroom sink, requires an individual to twist and turn his/her body and often arch his/her back. The present invention features an adjustable back platform device for supporting an individual's body and back when working in such a cabinet.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims. The back platform device of the present invention may help provide comfort to a user, and may help prevent pain or injury that may normally be caused when laying atop the corner edge of the cabinet. In addition, the platform device may be used as a tray to carry tools and materials to and from the cabinet.

DESCRIPTION OF PREFERRED EMBODIMENTS

Referring now to FIGS. 1-5, the present invention features an adjustable back platform device 100. The back platform device 100 functions to raise a user's back a certain distance off a floor or other ground surface so as to bring the user's body aligned with the bottom floor 101 of a cabinet 102 (e.g., when a user is fixing or installing plumbing components). Without wishing to limit the present invention to any theory or mechanism, it is believed that the back platform device 100 of the present invention is advantageous because it is easy to use, provides comfort, and may help prevent pain or injury normally caused when laying atop the corner edge of the cabinet. In addition, the platform device 100 may be used as a tray to carry tools and materials to and from the cabinet.

Figure 6:
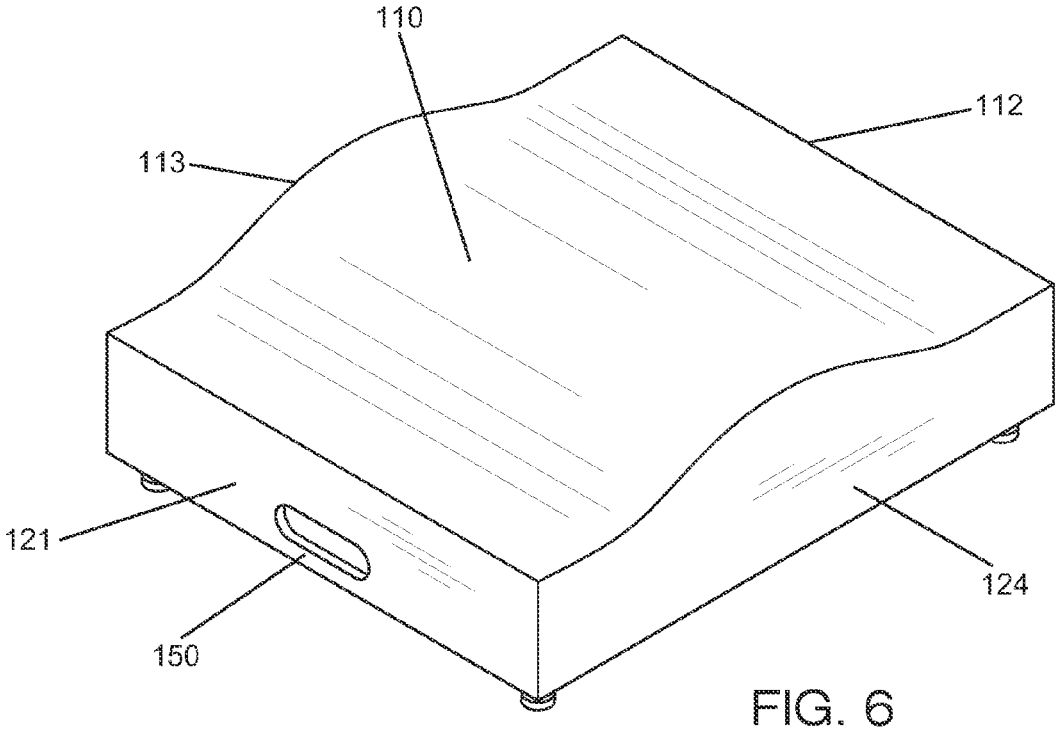
FIG. 6 is a perspective view of the adjustable back platform device having a contoured panel.

The adjustable back platform device 100 of the present invention comprises a panel 110. The panel 110 may be generally flat or shaped in a contoured manner to provide comfort to a user's back and/or neck and/or hips, etc. (see FIG. 6). A first side wall 121 extends downwardly (e.g., perpendicularly) from a first side edge 111 of the panel 110 and a second side wall 122 extends downwardly (e.g., perpendicularly) from a second side edge 112 of the panel 110. The first side wall 121 and second side wall 122 are generally opposite each other. The first side wall 121 and second side wall 122 may be generally parallel to each other.

In some embodiments, a third side wall 123 extends downwardly (e.g., perpendicularly) from a third side edge 113 of the panel 110. In some embodiments, a fourth side wall 124 extends downwardly (e.g., perpendicularly) from a fourth side edge 114 of the panel 110. The third side wall 123 and fourth side wall 124 are generally opposite each other. The third side wall 123 and fourth side wall 124 are generally parallel to each other. In some embodiments, the base panel 110 is flat extending from the first side wall 121 to the second side wall 122 and from the third side wall 123 to the fourth side wall 124. The first, second, third and fourth side walls surround the flat base panel 110 to form a cavity 126 at the bottom surface.

Figures 1, 2:
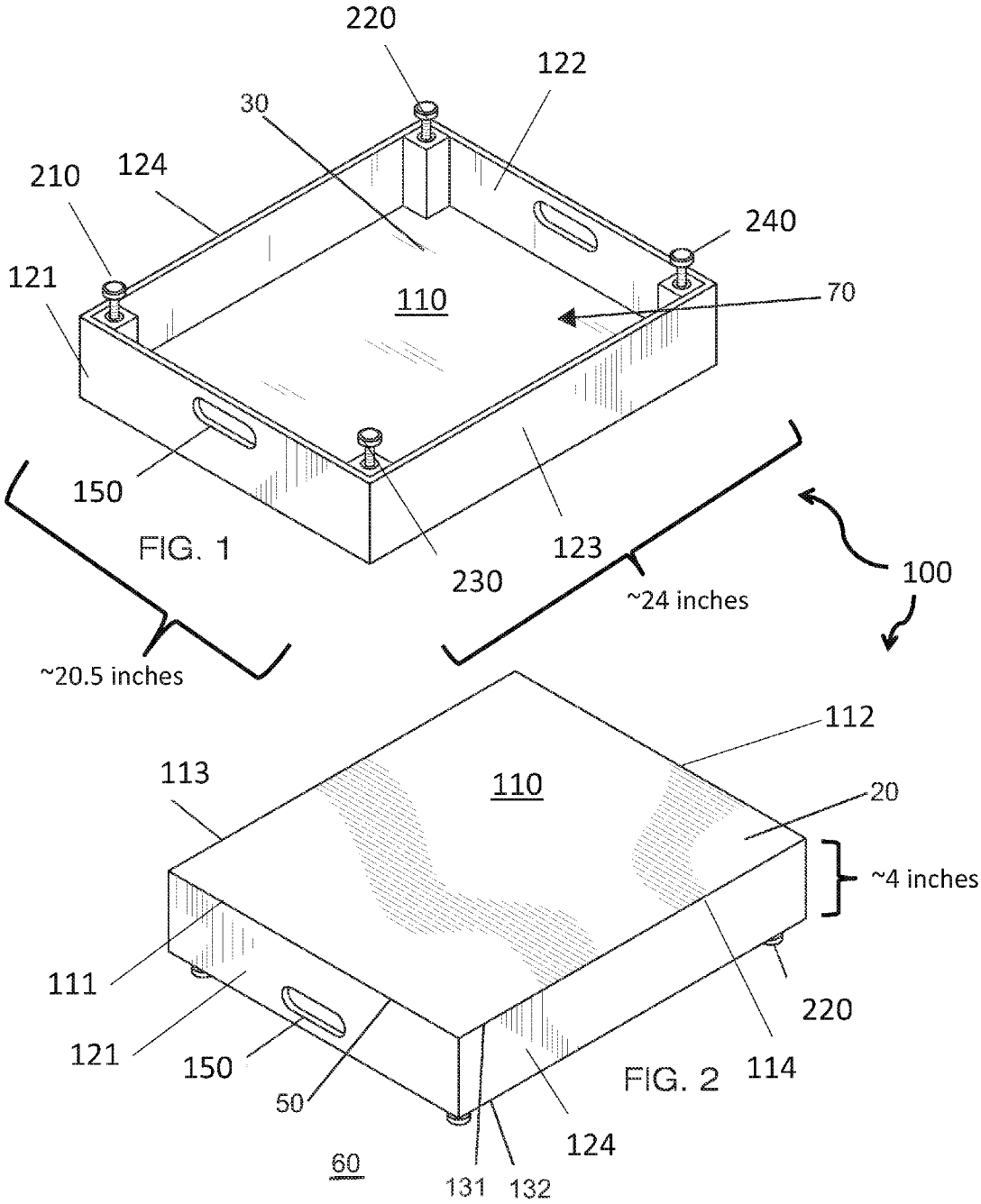
FIG. 1 is a bottom perspective view of the adjustable back platform device of the present invention.
FIG. 2 is a top perspective view of the adjustable back platform device of FIG. 1.
Figure 3:
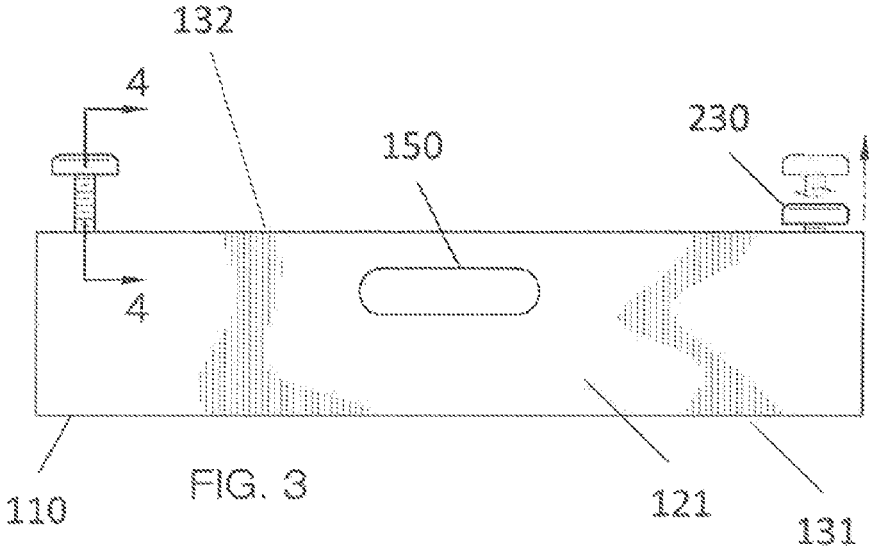
FIG. 3 is a front view of the adjustable back platform device of FIG. 1.
Figure 4:
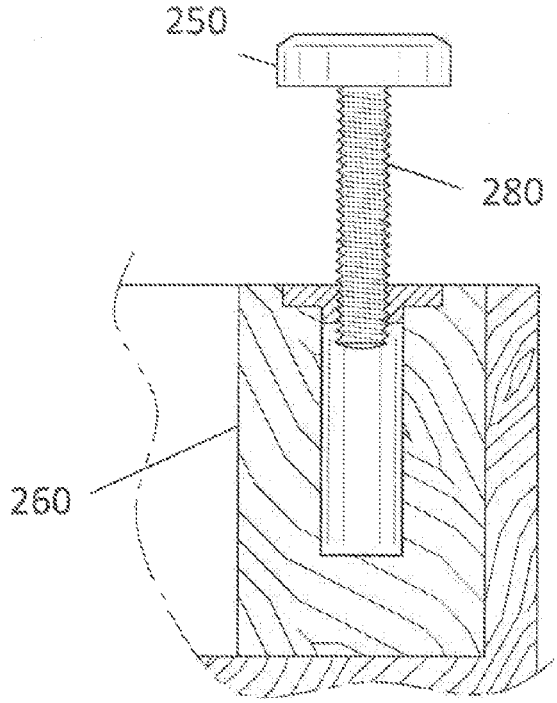
FIG. 4 is a cross sectional view of the adjustable back platform device of FIG. 1.
Figure 5:
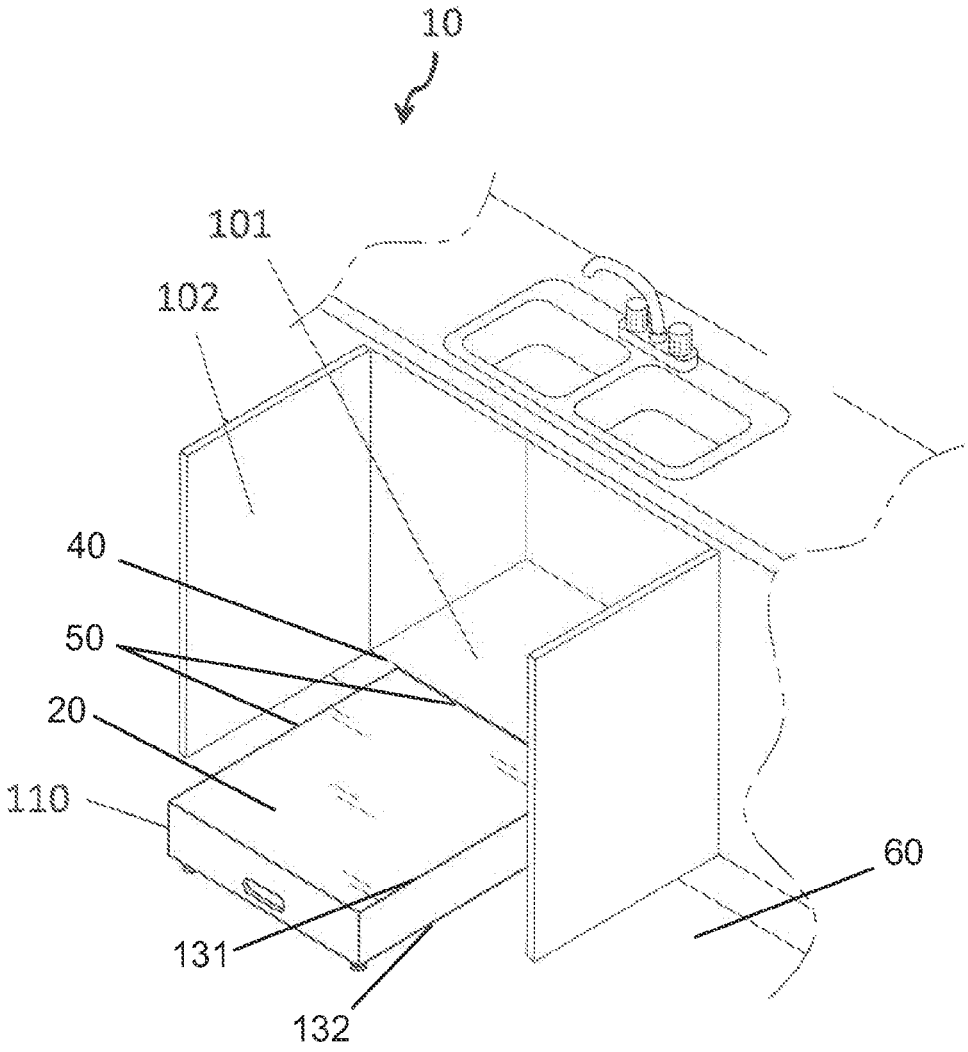
FIG. 5 is a perspective view of the adjustable back platform of FIG. 1 as used with a cabinet.

The side walls may be constructed in a variety of heights (as measured from a top edge 131 to a bottom edge 132 (see FIG. 3). In some embodiments, the preferred height is about 4.5 inches. In some embodiments, the side walls are between about 0.5 to 2 inches in height. In some embodiments, the side walls are between about 2 to 3 inches in height. In some embodiments, the side walls are between about 3 to 4 inches in height. In some embodiments, the side walls are more than about 4 inches in height. As shown in FIG. 2, in some embodiments, the side walls are about 4 inches in height.

The panel 110 may be constructed in variety of sizes. For example, in some embodiments, the panel 110 is between about 16 to 20 inches in width. In some embodiments, the panel 110 is between about 20 to 24 inches in width. In some embodiments, the panel 110 is more than about 24 inches in width. As shown in FIG. 1, the panel 110 may be about 20.5 inches in width. In some embodiments, the panel 110 is between about 20 to 24 inches in length. In some embodiments, the panel 110 is between about 24 to 30 inches in length. In some embodiments, the panel 110 is more than about 30 inches in length. As shown in FIG. 1, the panel 110 may be about 24 inches in length.

Disposed on the panel 110, for example on the bottom surface of the panel 110, is a first adjustable leg 210, a second adjustable leg 220, and a third adjustable leg 230. In some embodiments, a fourth adjustable leg 240 is disposed on the panel 110. The adjustable legs allow the distance between the panel 110 and the floor or ground surface to be adjusted. Generally, a user will adjust the legs so that the panel 110 is aligned with the floor of a cabinet (see FIG. 5).

In some embodiments, the adjustable legs are configured (e.g., arranged on the panel 110) such that the adjustable legs are at or near the four corners of the panel 110. In some embodiments, three adjustable legs are arranged in a generally triangular configuration on the bottom surface of the panel 110. The configuration of the adjustable legs is not limited to the aforementioned configurations.

The legs can provide additional height (e.g., space between the panel 110 and the ground surface or floor) in addition to the height provided by the side walls. In some embodiments, the legs provide between about 0.5 to 2 inches of additional height. In some embodiments, the legs provide between about 2 to 4 inches of additional height. In some embodiments, the legs provide more than about 4 inches of additional height.

The adjustable legs may be constructed in various ways to provide additional height. Adjustable legs and mechanisms of adjusting height are well known to one of ordinary skill in the art. For example, in some embodiments, the adjustable legs each comprise a leg brace 260 attached to the bottom surface of the panel 110. Disposed in the leg brace 260 is a channel adapted to receive a threaded shaft 280. The leg brace 260 has a first end attached to the bottom surface of the panel 110. The opposite second end faces away from the bottom surface of the panel 110. The channel may extend from the second end of the leg brace 260 to near the first end of the leg brace 260.

In some embodiments, the channel is threaded for engaging the threaded shaft 280. In some embodiments, a threaded nut is disposed in the channel for engaging the threaded shaft 280. The threaded shaft 280 can rotate in a first direction and a second direction to respectively insert the threaded shaft 280 into the channel and extend the threaded shaft 280 from the channel.

In some embodiments, a gripping foot 250 is disposed on the outer end of the threaded shaft. The gripping foot 250 may provide stability to the leg and help prevent the leg from slipping on the ground surface or floor.

In some embodiments a hole 150 is disposed in the first side panel 121 and in the second side panel 122. The holes 150 function as handles, allowing a user to lift the platform device 100. In some embodiments, the device 100 of the present invention can be flipped over (upside down) and the bottom surface of the panel 110 (in combination with the side walls) can be used as a tray.

As used herein, the term "about" refers to plus or minus 10% of the referenced number. For example, an embodiment wherein the side walls are about 2 inches in height include side walls that are between 1.8 and 2.2 inches in height.

The following the disclosures of the following U.S. Patents are incorporated in their entirety by reference herein: U.S. Pat. No. 4,700,945; U.S. Pat. Application No. 2001/0024022; U.S. Pat. Application No. 2006/0200909; U.S. Pat. No. 7,305,728; U.S. Pat. No. 3,677,569.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. An adjustable back platform system (10) comprising:

(a) an adjustable back platform and carrying tray device (100) comprising:

(i) a base panel (110) being between about 16 to 24 inches in width and 20 to 30 inches in length having a top surface (20) and a bottom surface (30), wherein when the top surface (20) faces upward, a first side wall (121) extends downwardly from a first side edge (111) of the base panel (110), a second side wall (122) extends downwardly from a second side edge (112) of the base panel (110), a third side wall (123) extends downwardly from a third side edge (113) of the base panel (110), and a fourth side wall (124) extends downwardly from a fourth side edge (114) of the base panel (110), the first side wall (121) being positioned opposite and generally parallel to the second side wall (122) and the third side wall (123) being positioned opposite and generally parallel to the fourth side wall (124), wherein the base panel (110) is shaped in a contoured manner to provide comfort to a user, wherein the first side wall (121), second side wall (122), third side wall (123) and fourth side wall (124) are between about 0.5 to 4.5 inches in height and surround the base panel (110) to form a cavity (70) at the bottom surface (30), wherein the base panel (110) first side edge (111), the second side edge (112), the third side edge (113), or the fourth side edge (114) are also platform top edges (50);

wherein when the bottom surface (30) faces upward, the cavity is adapted to form a carrying tray to transport tools and materials by the user;

(ii) a hole (150) disposed in both the first side wall (121) and in the second side wall (122), the holes (150) function as handles to allow the adjustable back platform device (100) to be lifted by the user;

(iii) a first adjustable leg (210), a second adjustable leg (220), and a third adjustable leg (230), each adjustable leg being disposed on a bottom surface (30) of the base panel (110), the adjustable legs allow a distance between the top surface (20) of the base panel (110) and a floor surface (60) to be modified to a first height from the floor surface (60); wherein when a user lies atop the top surface (20) of the base panel (110), the back platform device (100) functions to raise the user's back off the floor surface (60) so as to align the user's back with a bottom floor (101) of a cabinet (102); and (b) a cabinet (102) having a bottom floor (101) and a front edge (40), the surface of the bottom floor (101) having a second height as measured from the floor surface (60) to the surface of the bottom floor (101), the first height and the second height are equal, wherein the first side edge (111), the second side edge (112), the third side edge (113), or the fourth side edge (114) is positioned flush to the front edge (40) of the cabinet (102), wherein the top surface (20) of the base panel (110) is contiguous with the bottom floor (101) of the cabinet (102).

2. The adjustable back platform system (10) of claim 1 further comprising a fourth adjustable leg (240) disposed on the bottom surface (30) of the base panel (110).

3. The adjustable back platform system (10) of claim 1, wherein a gripping foot (250) is disposed on an end of each adjustable leg, the gripping foot (250) helps prevent the adjustable legs from slipping on the floor surface (60).

4. The adjustable back platform system (10) of claim 1, wherein the first adjustable leg (210), the second adjustable leg (220), and the third adjustable leg (230) are arranged in a generally triangular configuration on the bottom surface (30) of the base panel (110).

5. The adjustable back platform system (10) of claim 1, wherein the first adjustable leg (210), the second adjustable leg (220), and the third adjustable leg (230) each comprise a leg brace (260) attached to the bottom surface (30) of the panel (110), wherein a channel is disposed in the leg brace the channel is adapted to receive a threaded shaft (280).

6. The adjustable back platform system (10) of claim 5, wherein the threaded shaft (280) can rotate in a first direction and a second direction to respectively insert the threaded shaft (280) into the channel and extend the threaded shaft (280) from the channel.

* * * * *